United States Patent [19]

Massa

[11] Patent Number: 4,736,350

[45] Date of Patent: Apr. 5, 1988

[54] ELECTROMAGNETIC TRANSDUCERS FOR UNDERWATER LOW-FREQUENCY HIGH-POWER USE

[75] Inventor: Frank Massa, Cohasset, Mass.

[73] Assignees: Fred M. Dellorfano, Jr.; Donald P. Massa, both of Cohasset, Mass. ; Trustees of the Stoneleigh Trust u/d/t

[21] Appl. No.: 940,669

[22] Filed: Dec. 11, 1986

Related U.S. Application Data

[63] Continuation-in-part of Ser. No. 832,313, Feb. 24, 1986, Pat. No. 4,660,186.

[51] Int. Cl.[4] ..... H04R 13/00

[52] U.S. Cl. ..... 367/175; 367/142

[58] Field of Search ..... 367/141, 142, 149, 163, 367/166, 167, 168, 171, 172, 174, 175, 182, 184; 381/177, 192; 181/106, 113, 402

[56] References Cited

U.S. PATENT DOCUMENTS

| | | | |
|---|---|---|---|
| 2,419,608 | 4/1947 | Turner, Jr. | 367/175 |
| 3,225,326 | 12/1965 | Massa | 367/141 |
| 3,319,220 | 5/1967 | Massa, Jr. | 367/175 |
| 4,660,186 | 4/1987 | Massa | 367/175 X |

*Primary Examiner*—Charles T. Jordan
*Assistant Examiner*—Brian S. Steinberger

[57] ABSTRACT

The power handling capacity of a high-power low-frequency underwater transducer including an inertial mass-loaded vibratile piston assembly is greatly increased by increasing the heat conduction from the inertial mass member by designing the vibrating structure to place a surface area portion of the inertial mass member in direct thermal contact with the water environment in which the transducer is submerged. In order to reduce the sound radiation from the exposed surface of the submerged inertial mass member and to obtain a broadband response with a Q equal to 1 or less, a novel rigid hollowed piston construction is described which greatly reduces the weight-to-stiffness ratio of the vibratile plate and achieves the desired low Q as well as a reduction of sound radiation from the exposed inertial mass surface by at least 20 dB below the radiation from the surface of the vibratile plate member. An alternate piston construction is also described employing multiple layers of graphite fibres bonded together into a rigid lightweight piston having a very high stiffness-to-mass ratio to achieve the objects of the invention.

20 Claims, 2 Drawing Sheets

ELECTROMAGNETIC TRANSDUCERS FOR UNDERWATER LOW-FREQUENCY HIGH-POWER USE

This invention is concerned with improvements in underwater transmitting transducers which operate at high-power densities. It is a continuation in part of my copending application, Ser. No. 832,313, filed Feb. 24, 1986, now U.S. Pat. No. 4,660, 186 which describes an electromagnetic transducer element comprising a vibratile plate member driven by electromagnetic forces generated in an air gap maintained between an inertial mass structure and the vibratile plate member.

The transducer described in the copending application is a high-power, low-frequency transducer designed for high efficiency operation in the audible frequency region below approximately 3 kHz and capable of generating over 20 Watts of peak acoustic power per square inch of radiating surface. The maximum power limitation of the transducer will result either from cavitation that may occur if operating in shallow water outside of a pressurized dome, or by the temperature rise inside the transducer that could become excessive if operated continuously at very long duty cycles.

The primary object of this invention is to greatly reduce the temperature rise in an underwater electroacoustic transducer which employs a vibratile piston radiating surface mounted in operative vibrative relationship from an inertial mass member.

Another object of this invention is to greatly increase the heat conduction from the electromechanical vibrating structural portion of an underwater electroacoustic transducer and thereby increase the maximum power handling capacity of the transducer.

An additional object of this invention is to increase the power handling capacity of a high-power electromagnetic underwater transducer comprising an inertial mass-loaded vibratile piston as the sound radiating surface.

A still further object of this invention is to greatly increase the heat conduction from the inertial mass member of an underwater vibratile piston inertial mass-loaded electroacoustic transducer by designing the vibrating structure of the transducer to place a surface area portion of the inertial mass member in direct thermal contact with the water environment in which the transducer is submerged.

Another object of the invention is to increase the stiffness-to-mass ratio of the vibratile piston member of an electroacoustic transducer whereby the free flexural resonant frequency of the vibratile piston substantially exceeds the operating frequency of the transducer when it is operating underwater in the frequency region below approximately 3 kHz.

A further object of the invention is to greatly reduce the ratio of piston weight to inertial mass weight thereby to greatly reduce the ratio of the amplitude of the inertial mass member relative to the vibratile piston amplitude, and at the same time expose a large portion of the surface area of the inertial mass member directly to the water in which the transducer is submerged during operation whereby the water acts as a heat sink to very greatly reduce the temperature rise in the transducer during high-power operation.

Other objects of the invention will become more evident in the following detailed description of a preferred embodiment. The novel features which are characteristic of the invention are set forth with particularity in the appended claims. The invention itself, however, both as to its organization and method of operation, as well as advantages thereof, will best be understood from the following description of several embodiments thereof when read in connection with the accompanying drawings, in which:

Figure 2:
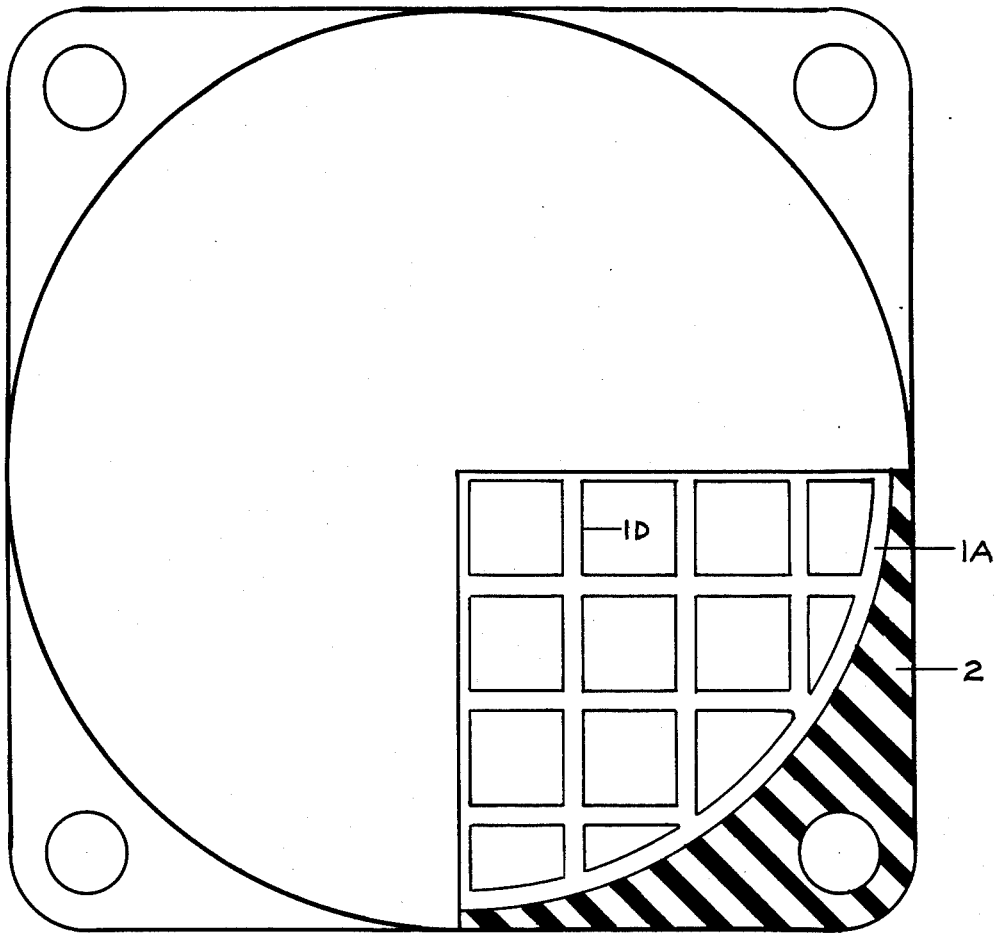
FIG. 2 is a partial cut-away plan view taken along the line 2—2 of FIG. 1 illustrating one type of construction of a vibratile piston to increase its stiffness-to-weight ratio to achieve one of the objects of my invention.
Figure 1:
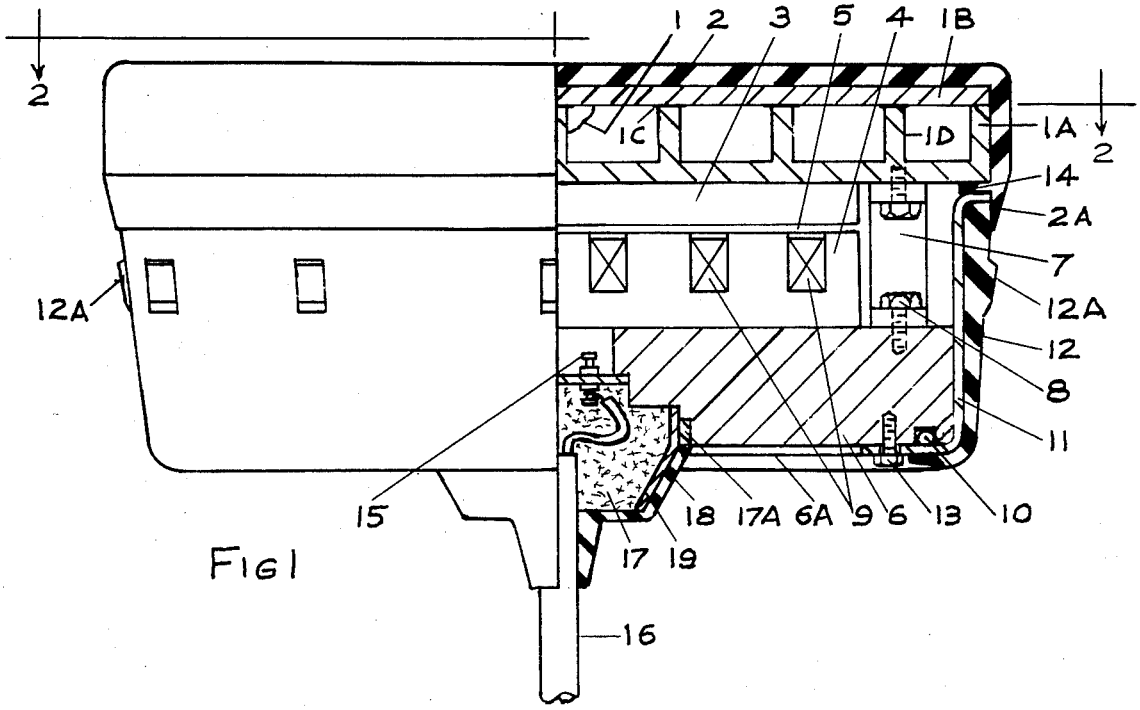
FIG. 1 is a partial cross-sectional view of a high-power, low-frequency electromagnetic transducer which is similar to the transducer illustrated in FIG. 1 of my copending application, except that it is modified to illustrate the features of my present invention.

Referring more specifically to FIGS. 1 and 2, the reference character 1 represents a vibratile plate structure comprising a composite aluminum piston made up of a cored lightweight structure 1A bonded to a lid-like thin flat sheet 1B by brazing or by using a rigid cement 1C such as epoxy. On the outer surface of the composite piston structure is molded a waterproof elastomer cap 2 as shown illustrated in FIG. 1. Although the composite vibratile piston 1 is illustrated in the drawings as a circular disc, it could be of any other shape such as square or hexagonal. A stack of I-shaped laminations 3 is bonded to the inner plane surface of the composite piston 1 using a suitable cement well known in the art such as epoxy. The free unbonded inner plane surface of the lamination stack 3 is accurately spaced from the unbonded free plane surface of the E-shaped lamination stack 4 to result in a uniform air gap 5. The flat base surface of the E-shaped lamination stack 4 is securely bonded with a suitable cement such as epoxy to the flat mating surface of the massive inertial base member 6 as illustrated in FIG. 1. The magnitude of the air gap is determined by the precise ground height of the spring members 7 which are fastened by the bolts 8 to the facing parallel plane surfaces of the piston 1 and inertial base member 6. The required stiffness of the springs 7 is determined by the desired frequency range of operation of the vibratile piston 1. Rectangular-shaped coils of insulated copper wire 9 are placed in each pair of slots provided in the E-lamination stack assembly 4 as illustrated. The coils are potted securely within the slots with any suitable potting compound well known in the art, such as epoxy, to insure that the coils become a rigid part of the electromagnetic assembly.

The remainder of the transducer assembly is illustrated in the partial cross-sectional view of FIG. 1. An O-ring 10 is fitted into the lower peripheral flat surface of the massive inertial base member 6 in order to seal the housing structure 11 when it is attached by the bolts 13 to become an outer cover to enclose the inner electromagnetic assembly portion of the transducer.

The metal housing 11 is preferably covered with a molded elastomer 12 such as neoprene. Tapered wedges 12A are molded around the periphery of the neoprene covering 12 as illustrated to serve as shock mounts when the transducer is mounted into an array frame. The tapered rubber wedges 12A will provide an interference fit between the rubber covered transducer housing and the hole diameter provided in the mounting frame structure to locate the transducer. The interference fit of the tapered rubber shock mounts will also provide mechanical damping for the array frame and thus prevent ringing of the frame structure when high-power acoustic signals are transmitted from the transducer during operation.

A peripheral rubber gasket 14 which may be a separate rubber washer, or an integral part of the inner surface of the molded rubber cap structure 2 is bonded between the mating peripheral surfaces of the composite piston 1 and the metal housing 11 using a suitable rubber-to-metal cement well known in the art. The thickness of the rubber gasket 14 is chosen such that the compliance of the gasket in combination with the mass of the housing 11 and inertial mass 6 resonate at a frequency below the operating frequency of the transducer and preferably approximately an octave or more below the operating frequency of the transducer. This will insure that the rear housing will remain uncoupled from the vibrating piston during the operation of the transducer.

The elastomer rubber cap 2 which is molded to the radiating surface of the piston 1 is provided with an overhanging cylindrical skirt portion 2A which at final assembly is stretched over the periphery of the rubber covering 12 which is molded over the outer surface of the housing member 11. Before stretching the skirt portion 2A over the mating rubber surface 12 the mating surfaces are coated with a suitable waterproof rubber cement, as is well known in the art, to insure a permanent waterproof seal at the overlapping joint.

The electrical coils 9 may be connected in series or parallel as desired to best suit the impedance requirement of the transducer assembly. The electrical connections to the coils 9 are brought out through insulated terminals 15 fitted into the recessed opening provided in the inertial mass member 6 as illustrated in FIG. 1. The conductors from an external waterproof cable 16 are soldered or otherwise suitable connected to the terminals 15 and the terminal compartment is then sealed with a potting compound 17 such as epoxy. After potting, the rubber cap 18 is stretched over the surface of the metal collar 19 which is fitted into the rear opening of the inertial mass member 6 as illustrated in FIG. 1. Potting compound 17A such as epoxy or polyurethane is used to seal the collar 19 to the surface of the inertial mass member 6 as illustrated. Rubber cement is applied over the mating surfaces of the rubber cap 18 and the metal collar 19 in the same manner as described for sealing the rubber skirt portion 2A to the outer periphery of rubber covering 12.

After the assembly of the transducer is completed, a large portion of the outer surface area 6A of the inertial mass member 6 remains exposed and comes in direct contact with the water into which the transducer is submerged during operation whereby the water acts as a heat sink to very greatly reduce the temperature rise in the transducer during high-power operation. In order to greatly reduce the radiation of sound from the exposed submerged rear surface 6A of the transducer inertial mass member 6 during operation, it is necessary to make the combined mass of the vibratile piston 1 plus the mass of the attached I-laminations 3 very much less than the combined mass of the inertial mass 6 plus the mass of the attached E-laminations 4 including the assembled coils 9. The reduction of sound radiation from the exposed rear surface 6A of the inertial mass member 6 must be in the order of 20 dB or more below the radiation of sound from the vibratile piston surface of the transducer to insure that the rear radiation of sound will have negligible effect in interferring with the radiation pattern from the vibratile piston surface. To achieve the desired 20 dB reduction in sound radiation from the exposed outer surface 6A of the immersed inertial mass member 6, the combined mass of the inertial mass 6 plus the attached E-laminations 4 and coils 9 must be at least 10 times greater than the mass of the vibratile piston plus the attached I-laminations 3.

If the transducer is required to operate over approximately an octave bandwidth located within the mid-audible frequency region defined as approximately 500 to 2,000 Hz, it is desireable to make the diameter of the vibratile piston greater than approximately $\frac{1}{8}$ wavelength of sound at the lowest operating frequency in the band in order to minimize the variation in mutual impedance between adjacent transducers when mounted in an array. In addition, a high-stiffness low-weight piston construction is required in order that the free flexural resonant frequency of the vibratile piston assembly occurs preferably at least an octave above the operating frequency of the transducer.

In order for the transducer to have a uniform transmitting response characteristic over an octave bandwidth, the Q of the electromechanical vibrating system should preferably be less than 1 when the transducer is being operated under rho-c loaded conditions. To achieve a Q less than 1, the magnitude of the mechanical reactance of the vibratile piston assembly must be less than the magnitude of the radiation resistance of the piston. This relationship may be expressed as $$2\pi f_c m_o < \rho c A_o \quad (1)$$

where:

$f_c$=mid-frequency of the desired operating bandwidth in Hertz $m_o$=total mass of the vibratile piston assembly in grams $\rho c$=150,000 ohms/cm$^2$ under rho-c loading $A_o$=total area of the vibratile piston assembly in sq.cm Solving equation (1) for $m_o$ gives the value $$m_o < \frac{23800}{f_c} A_o \text{ gms.} \quad (2)$$

As an illustrative example assume that the desired value of $f_c$ equals 1000 Hz and the piston area $A_o$=1300 sq.cm; then by substituting these values in equation (2), the total mass of the vibratile plate assembly, $m_o$, must be less than 30 kg. Since the mass of the magnetic laminations 3 cannot be reduced without reducing the strength of the magnetic field in the air gap, it becomes one of the important requirements of this invention to reduce the mass of the vibratile piston member without at the same time proportionately reducing the flexural stiffness of the piston such as would occur if the mass reduction were achieved simply by using a thinner piston plate.

One satisfactory piston construction used by the inventor to achieve the stated objectives is illustrated in FIGS. 1 and 2 of the drawings. As described above, the vibratile plate member 1 comprises a composite cored lightweight assembly including a fabricated or cast relatively thick aluminum plate 1A which is hollowed out by the ribbed stiffening grid construction as illustrated by the grid walls 1D. A relatively thin flat cover plate 1B is rigidly fastened to the open end of the grid by any suitable means such as rigid epoxy 1C as previously mentioned.

Figure 3:
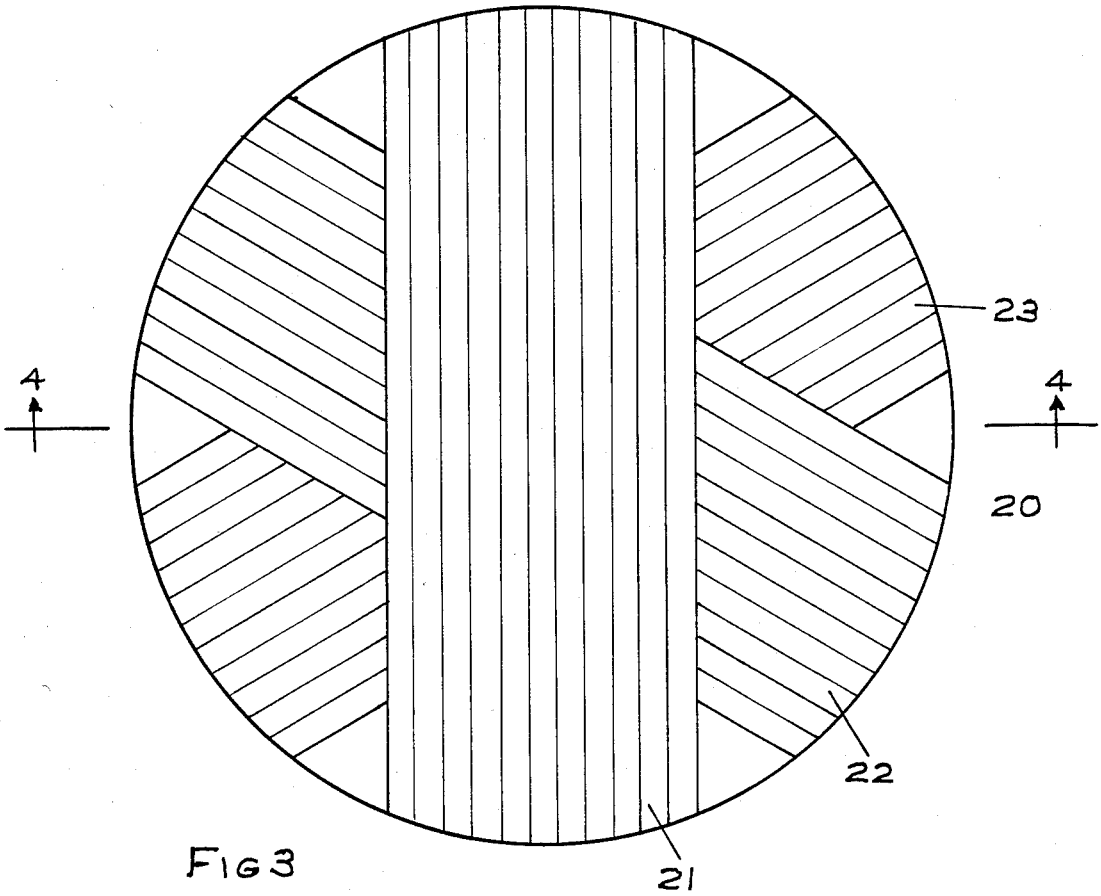
FIG. 3 illustrates another type of construction of the vibratile piston member of the transducer whereby the stiffness-to-mass ratio of the piston is increased to achieve an object of my invention.
Figure 4:
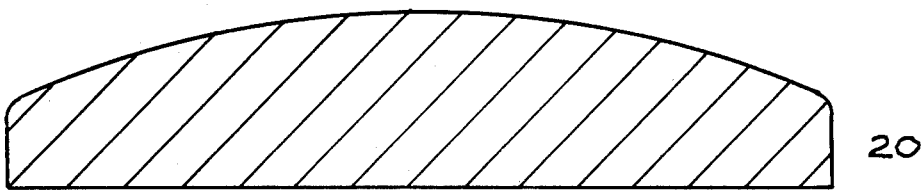
FIG. 4 is a section taken along the line 4—4 in FIG. 3.

An alternate design of a rigid lightweight piston structure 20 is illustrated in FIGS. 3 and 4. Several layers of high-modulus high-tensile strength filaments 21, 22, 23 are stretched in overlapping ribbonlike strips, using a rigid epoxy cement between layers and then molding the built-up layers into a rigid structure having the cross-sectional shape illustrated in FIG. 4. The filament strips are preferably placed at 120° from one another during assembly so that the center will build up into a symmetrical convex shape as illustrated in FIG. 4. A very suitable filament material to use for making the structure is graphite fibre which has a modulus of elasticity, when stretched, within the range $40\times10^6$ to $60\times10^6$ lbs./sq. in. which is 2 or 3 times the modulus of steel wire. Combined with its very low density as compared to steel the use of graphite fibres will result in a very high stiffness-to-mass ratio for the solid piston illustrated in FIGS. 3 and 4. The piston 20, after fabrication, may be substituted for the composite cored aluminum piston shown in FIGS. 1 and 2 and then covered with a molded elastomer cap 2 in the same manner as described for the composite piston 1.

Although a few specific embodiments of the present invention have been shown and described, it should be understood that various additional modifications and alternative constructions may be made without departing from the true spirit and scope of the invention. Therefore, the appended claims are intended to cover all such equivalent alternative constructions that fall within their true spirit and scope.

I claim:

1. In combination in an underwater transducer comprising an inertial mass-loaded vibratile piston assembly designed for underwater generation of high-power acoustic energy densities in excess of approximately 20 peak Watts per square inch of radiating surface, a vibratile plate having an outer surface adapted for transmitting oscillatory mechanical vibrations into the water when the transducer is immersed therein, said vibratile plate also having a flat inner plane surface, electromechanical oscillatory force generating means attached in operative relationship between said plane surface of said vibratile plate and an inertial mass member, a waterproof housing structure for enclosing said electromechanical oscillatory force generating means, sealed insulated electrical terminal means associated with said waterproof housing structure for establishing external electrical connection to said enclosed electromechanical oscillatory force generating means, means for sealing said waterproof housing structure to said inertial mass member, said housing structure characterized in that it has an opening through which a portion of the surface area of said inertial mass member is directly exposed to the sea when said transducer is immersed therein during operation.

2. The invention in claim 1 characterized in that the weight of said inertial mass member is in the order of ten times or more than the weight of said vibratile plate whereby the amplitude of vibration of the inertial mass member during opeation is approximately one-tenth the amplitude of vibration of said vibratile plate.

3. The invention in claim 1 characterized in that said vibratile plate comprises a composite assembly of a cored relatively thick plate section and a relatively thin plate section rigidly fastened to the open end of a hollowed core section.

4. The invention in claim 1 characterized in that said vibratile plate comprises a solid piston fabricated with multiple layers of high-modulus high-tensile strength filament material held together with rigid cement to form a compact lightweight solid structure having a higher stiffness-to-mass ratio than if the plate were fabricated in solid aluminum and solid steel.

5. The invention in claim 4 further characterized in that said filament material comprises multiple layers of overlapping multi-filament ribbon-like strips and still further characterized in that the axis of each successive overlapping strip makes an angle with the axis of the ribbon-like strip over which it overlaps.

6. The invention in claim 5 characterized in that said overlapping angle is approximately 120°.

7. The invention in claim 1 characterized in that said electromechanical oscillatory force generating means comprises an electromagnetic structure including an air gap and means for supplying an oscillatory magnetic field within said air gap which in turn generates an oscillatory force between said vibratile plate and said inertial mass member.

8. The invention in claim 7 further characterized in that the peak value of said oscillatory magnetic field exceeds approximately 17,000 gausses at maximum power output of said vibratile plate.

9. The invention in claim 8 further characterized in that the peak value of said oscillatory magnetic field is at least 18,000 gausses.

10. In combination in an electromagnetic transducer assembly designed for efficient underwater generation of high-power acoustic energy densities in excess of approximately 20 peak Watts per sq. in. of radiating surface when operating at a mid-audible frequency located within the approximate range 500 Hz to 2500 Hz under conditions of 100% rho-c loading, a vibratile circular plate having an outer surface adapted for transmitting oscillatory mechanical vibrations into the water when a transducer is immersed therein, said vibratile circular plate also having an inner plane surface, a first magnetic flux conducting structure having a specified thickness defined by two parallel plane surfaces, means for rigidly attaching the first one of said two parallel plane surfaces of said first magnetic flux conducting structure to the said inner plane surface of said vibratile circular plate, a massive inertial cylindrical base member characterized in that it has at least one circular plane surface, and also characterized in that the diameter of said circular plane surface is comparable to the diameter of said vibratile circular plate, a second magnetic flux conducting structure having a specified thickness defined by two parallel plane surfaces, means for rigidly attaching the first one of said two parallel plane surfaces of said second magnetic flux conducting structure to the said plane surface of said massive inertial base member, said second parallel surface of said second magnetic flux conducting structure characterized in that a plurality of pairs of slots are provided into the said second parallel plane surface of said second magnetic flux conducting structure, a plurality of coils wound with insulated electrical conductors and dimensioned to fit with adequate clearance within said plurality of pairs of slots provided into the said second parallel plane surface of said second magnetic flux conducting structure, rigid potting means filling a clearance space between said coils and said slots, a plurality of spring members characterized in that their overall length dimensions are precisely machined to a uniform specified height, first fastening means for attaching one end of said spring members to the peripheral area of said inner plane surface of said vibratile circular plate, second fastening means for attaching the opposite end of said spring members to the peripheral area of said flat plane surface of said massive inertial base member, the uniform specified height of said plurality of spring members and the precise location of the springs on the peripheral flat surfaces of said vibratile circular plate and said inertial base member establish a specified uniform air-gap dimension between said first and said second magnetic flux conducting structure, a tubular housing structure for enclosing said electromagnetic transducer assembly having an opening at each end, the first of said two openings characterized as having an annular flat surface whose outside diameter is approximately equal to the outer diameter of said vibratile plate, the inside diameter of said annular flat surface is sufficient to clear the electromagnetic assembly of said transducer, means for sealing the periphery of said second opening in said tubular housing structure to the peripheral surface of said inertial mass member, a waterproof elastomer cap bonded to said outer surface of said vibratile circular plate, said elastomer cap including a thin circular peripheral skirt portion extending axially and surrounding the outer peripheral edge of said vibratile circular plate, an annular flexible flat gasket having an external diameter approximately equal to the diameter of said vibratile circular plate and an internal diameter approximately equal to the inner diameter of said first open end of said housing structure, said flat gasket located between the periphery of the inner plane surface of said vibratile circular plate and the annular flat surface of said first open end of said housing structure, sealed insulated electrical terminal means associated with said inertial mass member and a tubular housing assembly means for establishing external electrical connection to the enclosed electromagnetic assembly, electrical connection means from said plurality of coils to said terminal means, and means for generating controlled electromagnetic forces in the magnetic air gap by supplying controlled electrical power to said electrical terminal means.

11. The invention in claim 10 characterized in that the weight of said inertial mass member is in the order of ten times or more than the weight of said vibratile plate whereby the amplitude of vibration of the inertial mass member during operation is approximately one-tenth the amplitude of vibration of said vibratile plate.

12. The invention in claim 11 characterized in that said vibratile plate comprises a composite assembly of a cored relatively thick plate section and a relatively thin plate section rigidly fastened to the open end of the hollowed cored section.

13. The invention in claim 11 characterized in that said vibratile plate comprises a solid piston fabricated with multiple layers of high-modulus high-tensile strength filament material held together with rigid cement to form a compact lightweight solid structure having a higher stiffness-to-mass ratio than if the plate were fabricated in solid aluminum and solid steel.

14. The invention in claim 13 further characterized in that said filament material comprises multiple layers of overlapping multi-filament ribbon-like strips and still further characterized in that the axis of each successive overlapping strip makes an angle with the axis of the ribbon-like strip over which it overlaps.

15. The invention in claim 14 characterized in that said overlapping angle is approximately 120°.

16. The invention in claim 10 characterized in that said annular flexible gasket is an integral portion of said elastomer cap bonded to the outer surface of said vibratile circular plate.

17. The invention in claim 10 characterized in that said tubular housing structure includes an elastomer covering bonded to its outer surface.

18. The invention in claim 17 further characterized in that a plurality of tapered projections are spaced around the circumference of the elastomer covering which is bonded to the outer surface of said housing structure.

19. The invention in claim 10 characterized in that the compliance of said annular gasket is sufficiently high to insure that the resonance frequency of said outer housing and inertial mass assembly in combination with the compliance of said annular gasket occurs below the operating frequency of the transducer.

20. The invention in claim 19 further characterized in that said resonance frequency is approximately an octave below the operating frequency of the transducer.

* * * * *